United States Patent [19]

Kohl

[11] 4,208,848

[45] Jun. 24, 1980

[54] DECORATIVE SYSTEM

[76] Inventor: Richard C. Kohl, 1335 E. Kaler Dr., Phoenix, Ariz. 85020

[21] Appl. No.: 932,213

[22] Filed: Aug. 9, 1978

[51] Int. Cl.[2] ..... E06D 7/62

[52] U.S. Cl. ..... 52/171; 52/311; 40/406

[58] Field of Search ..... 52/171, 306, 311; 40/406, 407, 408; 428/38; 350/312; 272/8 R, 8 D, 8 P

[56] References Cited

U.S. PATENT DOCUMENTS

| | | | |
|---|---|---|---|
| 1,795,128 | 3/1931 | Honig | 40/407 |
| 2,123,932 | 7/1938 | Carriveau | 40/407 |
| 3,387,396 | 6/1968 | Smith | 40/406 |
| 4,053,210 | 10/1977 | Michaelis | 52/306 X |
| 4,093,352 | 6/1978 | Pisar | 52/171 X |

*Primary Examiner*—Price C. Faw, Jr.
*Assistant Examiner*—Carl D. Friedman
*Attorney, Agent, or Firm*—Martin L. Stoneman

[57] ABSTRACT

A decorative system including a transparent container holding a described decorative aqueous mixture including aluminum powder and the system further providing means for bubbling air through the mixture for optimum effect.

2 Claims, 7 Drawing Figures

DECORATIVE SYSTEM

BACKGROUND OF THE INVENTION

This invention relates to decorative systems for church, home, or commercial use.

More particularly, the invention concerns a decorative system providing the beauty and utility of moving liquid patterns seen through a transparent container.

In a further aspect, the invention concerns a decorative system adapted for a variety of uses and which may particularly and with great utility replace stained glass window systems of the type most ordinarily found in churches.

Among the problems associated with the use of decorative systems containing decorative mixtures, liquids, plastics, etc. are problems associated with providing movement within the system. If movement is not provided, any decorative mixtures of this type will tend, at worst, to settle in time due to gravity and lose much if not all of their beauty. At best, a great decrease in the optimum level of beauty and utility is experienced. Additionally, the provision of adequate illumination for optimum effect is often a problem, bright sunlight being best for many uses although indoor decoration is most commonly desired.

Also, particularly in areas of use presently associated with stained glass windows, inordinate expense is often required to obtain stained glass of the appropriate composition color, etc. Furthermore, since the color is built into the glass, the need or wish to alter the artistic configuration and looks of a stained glass window installation is accompanied by the inordinate expense of completely altering or replacing the window system.

It would be highly advantageous, therefore, to provide a decorative system of the type containing a decorative aqueous mixture which is not only adapted efficiently to provide proper movement of the mixture, but that provides also for the solution of the other problems hereinbefore mentioned with respect to the prior art.

SUMMARY OF THE INVENTION

Accordingly, it is the primary object of the present invention to provide an improved decorative system.

Another object of the present invention is the provision of a decorative system of the type containing a decorative aqueous mixture.

Still another object is to provide a decorative system of this type which efficiently provides for movement of the mixture. Yet another object of the present invention is the provision of a decorative system of the above type which may be used in the place of stained glass windows and provides for exceptional beauty and utility without all of the above-mentioned disadvantages of stained glass window systems.

Yet still another object of the present invention is the provision of a decorative device of the above type which is efficient in its manner of operation, relatively inexpensive to manufacture, and having high degree of durability and serviceability.

Briefly, to accomplish the desired objectives of the present invention in accordance with a presently preferred embodiment thereof, there is provided an essentially-transparent containing means which contains a decorative aqueous mixture therewithin. Decorative movement within the mixture is produced by mechanical means preferably constructed and arranged to bubble air through the mixture. The aqueous mixture includes twenty-five parts to one hundred parts of aluminum powder (preferably fifty parts) for each five thousand parts of water and further includes one to six parts of a mixing agent, preferably in the form of household dishwashing detergent. The mixture may further include one to ten parts of a coloring agent in the form of household food coloring. In a preferred embodiment, the containing means comprises a windowpane structure having at least one hollow portion therewithin which hollow portion communicates with at least one air entry opening and at least one air exit opening constructed and arranged so that air may be bubbled through the aqueous mixture. In a further preferred embodiment, the windowpane structures are arranged in modular fashion, and the aqueous mixture may have different coloring agents in the aqueous mixture contained in different windowpanes; and further, with respect to such embodiment, a single means of air production may be utilized for all of the multiple panes.

BRIEF DESCRIPTION OF THE DRAWINGS

Further and more specific objects and advantages of the present invention will become readily apparent to those skilled in the art from the following detailed description thereof taken in connection with the drawings, in which.

DETAILED DESCRIPTION OF THE PREFERRED EMBODIMENT

Figure 1:
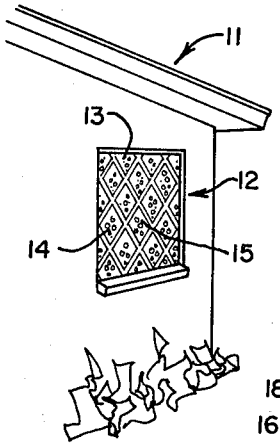
FIG. 1 is an artistic view showing individual units of a preferred embodiment of the present invention installed in a building structure.

Turning now to drawings, in which the reference numerals indicate corresponding elements throughout the several views, FIG. 1 illustrates a building 11 containing a window unit 12 containing a multiple number of individual units or panes, for example, units 13, 14, and 15. Both the individual units, as 13, and the multiple unit 12 may be manufactured as preferred embodiments in accordance with the teachings of the present invention herein set out.

Figure 2:
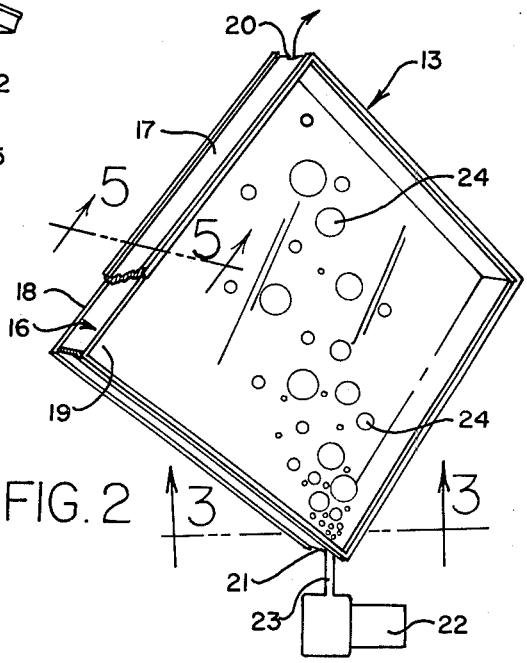
FIG. 2 is a perspective view illustrating a single unit of a preferred embodiment of the present invention.

FIG. 2 shows a decorative system unit 13 in accordance with a preferred embodiment of the present invention. Unit 13 forms a container holding decorative mixture 16 and includes frame 17, rear glass plate 18, and front glass plate 19. Frame 17 includes air outlet 20 at its top and air inlet 21 at its bottom. Further illustrated in FIG. 2 is a source of air such as air pump 22 which provides air flow to unit 13 by way of air line 23. In operation air flows from air pump 22 through air line 23 and into unit 13 by way of air inlet 21. As the air passes through decorative mixture 16 (illustrated by bubbles 24), the flow of air provides movement within decorative mixture 16 and sufficient air flow should be utilized in accordance with the teachings of the present invention to provide for optimum beauty and mixing. After passing through decorative mixture 16, the air leaves unit 13 by way of air outlet 20.

Figure 3:
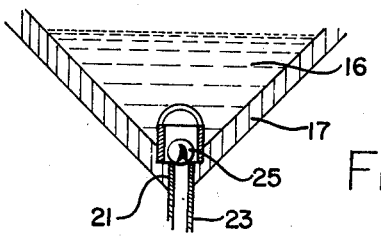
FIG. 3 is a sectional view through the section 3—3 of FIG. 2 illustrating how a valve means may be used to contain the decorative mixture of the present invention within the decorative system.

With respect to FIG. 3, a sectional view through the section 3—3 of FIG. 2, there is shown one specific structure suitable in the preferred embodiment for the treatment of the air inlet 21. Shown mounted in frame 17 for use in a well known manner is ball check valve 25. When unit 13 is filled with decorative mixture 16, the ball check valve 25 prevents the leakage of decorative mixture 16 into air line 23. However, as will be evident to those skilled in the art, when the air pressure in air line 23 is sufficient, ball check valve 25 will permit air to flow through air inlet 21.

Figure 4:
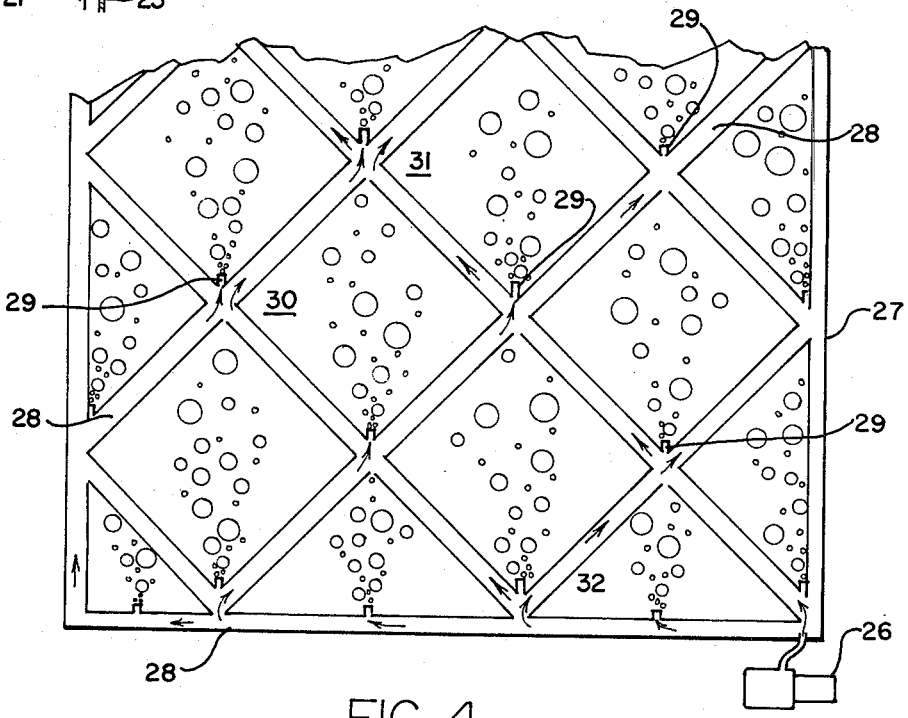
FIG. 4 is a partial sample sectional view through a decorative system of the present invention utilizing multiple single units and a single source of air flow and illustrating the flow of air through channels to reach each unit.

FIG. 4 illustrates the inlet air flow pattern of one preferred embodiment of the present invention, which may be similar to multiple unit 12 illustrated in FIG. 1. A source of compressed air 26 is connected to communicate with inside air passages (as shown by the air flow arrows) within frame 27. Each air flow passge 28 is in communication both with compressed air source 26 and each air inlet valve 29 communicating with each illustrated window individual unit, for example as at 30, 31 and 32. Thus, air, as shown, may bubble through the decorative mixture of the present invention.

Figure 5:
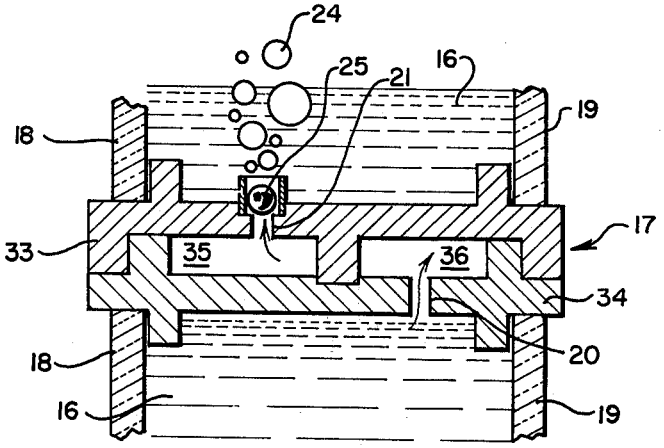
FIG. 5 is a sectional view through the section 5—5 of FIG. 2 and specifically illustrates how the frame of the preferred embodiment of the present invention may be utilized to provide channels for incoming and outgoing air, including illustrative examples of an air entry and air exit.

FIG. 5 most clearly illustrates one specific structure for a preferred embodiment of the frame 17 of the present invention, the frame section being taken through section 5—5 of FIG. 2, but for illustrative purposes, illustrating the position within the frame 17 of air outlet 20 and air inlet 21 situated respectively at the top and bottom of each individual unit 13. Frame channel members 33 and 34 are illustrated in cross section and are designed to fit, each with the other, so as to provide a channel 35 to transport incoming air and a channel 36 to transport outgoing air, as illustrated. The arrows in FIG. 5 illustrate air flow direction.

Figure 6:
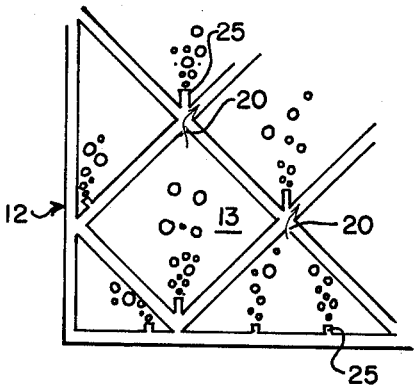
FIG. 6 is a partial view of a portion of a multiple-unit embodiment of the present invention further illustrating one preferred embodiment of the present invention.
Figure 7:
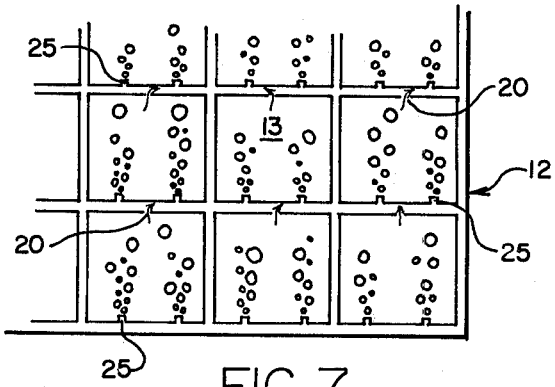
FIG. 7 is a view similar to that of FIG. 6, but illustrating another preferred embodiment of the present invention showing another way in which the individual units of the present invention may be used.

FIGS. 6 and 7 illustrate, for the sake of clarity, other arrangements of individual units 13 to make multiple units 12 and, therein, other preferred locations of air inlet valves 25 and air outlets 20. FIGS. 6 and 7 are not intended to illustrate the details of construction of the frame to provide various needed passages, but only to illustrate the matters above set forth.

Decorative mixture 16 of the present invention is a decorative aqueous mixture preferably comprising about fifty parts by volume of aluminum powder for each five thousand parts of water. To obtain the decorative effects provided by the decorative system of the present invention the preferred decorative aqueous mixture should include at least about one-half percent of aluminum powder by volume. A further preferred range for aluminum powder content in said decorative aqueous mixture is from about twenty-five parts to about one hundred parts of aluminum powder by volume for each five thousand parts of water.

Further, for the preferred decorative aqueous mixture of the present invention which includes from about twenty-five parts to about one hundred parts by volume of aluminum powder for each five thousand parts of water, a mixing agent, preferably in the form of a household dishwashing detergent, assists the aluminum in mixing well with the water to better provide a preferred decorative effect for the decorative system of the present invention. The preferred range for household dishwashing detergent in the decorative aqueous mixture of the present invention is from about one part to about six parts of detergent for each five thousand parts of water. A specific example of such detergent which works effectively in the decorative aqueous mixture of the present invention is that known as Joy (a registered trademark) dishwashing detergent.

The decorative effect of the decorative system of the present invention is most preferably obtained when a coloring agent is added to the decorative aqueous mixture of the present invention. To achieve the optimum effect of the present decorative system the decorative aqueous mixture of the present invention may include from about one part to about ten parts for each five thousand parts of water of a coloring agent of the form of household food coloring. An example of a household food coloring product which may be used effectively in the present invention is that product known as Schilling (a registered trademark) food colors.

Further, a specific example of aluminum powder which produces optimum decorative effect in the system of the present invention is that known as #32 Sunbrite Chemically Pure Aluminum Luco ( a registered trademark) aluminum powder.

It may be seen, with reference to FIG. 1, that a decorative effect which may be compared to that of stained glass may be obtained if, for example, the units 13, 14, and 15 contain therein essentially different colors of the decorative aqueous mixture of the present invention. If the decorative aqueous mixture of the present invention is mixed and moving as taught herein by applicant, light striking the decorative aqueous mixture will not only be colored passing through, for example, unit 15, but both inside and outside light will be reflected to the eye of the viewer from aluminum powder particles within the present decorative aqueous mixture, thus providing a most useful and beautiful effect. If is further seen that the specific shapes of the hollow portions within the containing means of the present invention may be varied also in addition to the variation in color between such hollow portions, thus providing an improved decorative system having optimum artistic flexibility for use by architects, decorators, and others.

Various changes in the system and devices herein shown for the purpose of illustration will readily occur to persons skilled in the art. Such modifications and variations, while not explicitly denoted in the foregoing detailed description of the preferred embodiment, do not deviate from the teachings of the present invention and are intended to be included in the spirit and scope thereof, and the scope of the present invention is intended to be limited only by a fair interpretation of the following claims:

I claim:

1. A decorative system including:

a. essentially-transparent containing means;

b. a decorative aqueous mixture within said containing means;

c. mechanical means for producing decorative movement within said aqueous mixture;

d. said decorative aqueous mixture including at least about one-half percent by volume of aluminum powder;

e. said mechanical means being constructed and arranged to bubble air through said decorative aqueous mixture;

f. said containing means being comprised of a windowpane structure having at least one hollow portion therein containing said decorative aqueous mixture;

g. said hollow portion of said windowpane structure communicating with at least one air entry opening and at least one air exit opening; and h. said containing means comprising multiple windowpane structures each having at least one said hollow portion therein and said system including a single source of compressed air in communication with each said hollow portion.

2. The decorative system of claim 1 wherein the decorative aqueous mixture in one said windowpane structure is an essentially different color than the decorative aqueous mixture in another of said windowpane structures.

* * * * *